US012233311B2

(12) United States Patent
Pennington

(10) Patent No.: US 12,233,311 B2
(45) Date of Patent: Feb. 25, 2025

(54) ABDOMINAL EXERCISE DEVICE

(71) Applicant: Steve Pennington, Van Alstyne, TX (US)

(72) Inventor: Steve Pennington, Van Alstyne, TX (US)

( * ) Notice: Subject to any disclaimer, the term of this patent is extended or adjusted under 35 U.S.C. 154(b) by 219 days.

(21) Appl. No.: 18/130,420

(22) Filed: Apr. 3, 2023

(65) Prior Publication Data

US 2024/0325818 A1 Oct. 3, 2024

(51) Int. Cl.

| | |
|---|---|
| ***A63B 23/02*** | (2006.01) |
| ***A63B 21/00*** | (2006.01) |
| ***A63B 21/002*** | (2006.01) |
| ***A63B 22/20*** | (2006.01) |

(52) U.S. Cl.

CPC ..... *A63B 23/0205* (2013.01); *A63B 21/002* (2013.01); *A63B 21/4033* (2015.10); *A63B 22/20* (2013.01); *A63B 2208/0257* (2013.01)

(58) Field of Classification Search

CPC ... A63B 21/4033; A63B 21/002; A63B 22/20; A63B 2208/0257; A63B 23/0205; A47C 9/002; A47C 9/005; A47C 9/007

See application file for complete search history.

(56) References Cited

U.S. PATENT DOCUMENTS

| | | | | |
|---|---|---|---|---|
| 3,824,991 | A * | 7/1974 | Whitaker | A47C 9/002 601/5 |
| 7,213,819 | B2 | 5/2007 | Carbonero | |
| 7,361,123 | B1 * | 4/2008 | Krull | A63B 21/4029 482/52 |
| 7,591,763 | B1 * | 9/2009 | Fucci | A63B 21/4013 482/52 |
| D744,713 | S | 12/2015 | Della Polla | |
| 9,750,980 | B1 | 9/2017 | Khalili | |
| 11,413,498 | B2 | 8/2022 | Mcintyre | |
| 11,596,850 | B2 * | 3/2023 | Brasch | A63B 23/1218 |
| 2006/0070556 | A1 * | 4/2006 | Burton | A47B 31/00 108/77 |
| 2014/0336024 | A1 | 11/2014 | Huang | |
| 2016/0220862 | A1 | 8/2016 | Johnson | |
| 2017/0259109 | A1 * | 9/2017 | McJames, II | A63B 22/0015 |
| 2020/0298054 | A1 | 9/2020 | Manion | |
| 2021/0128401 | A1 | 5/2021 | Yao | |
| 2021/0228937 | A1 * | 7/2021 | Pence | A63B 23/0405 |

FOREIGN PATENT DOCUMENTS

| | | |
|---|---|---|
| WO | WO2021072176 | 4/2021 |

* cited by examiner

*Primary Examiner* — Zachary T Moore

(57) ABSTRACT

An abdominal exercise device for simultaneously exercising core muscles and a cardiovascular system includes a platform, which comprises a top plate, a pair of endplates, and a plurality of wheels. Each endplate is attached singly proximate to and extends substantially perpendicularly from a respective opposed end of the top plate. Each wheel is attached to a respective endplate distal from the top plate. The wheels enable locomotion of the platform in any direction upon a substantially horizontal surface. The platform supports legs of a user who is performing a plank exercise and enables the user to move along the substantially horizontal surface using their arms, thereby exercising at least core muscles and a cardiovascular system of the user.

19 Claims, 11 Drawing Sheets

ABDOMINAL EXERCISE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercise devices and more particularly pertains to a new exercise device for simultaneously exercising core muscles and a cardiovascular system. The present invention discloses an exercise device that supports legs of a user in a comfortable position as the user performs a plank exercise entailing use of one's arms to motivate the platform in any direction upon a substantially horizontal surface.

(2) Description of Related Art Including Information Disclosed Under 37 CFR 1.97 and 1.98

The prior art relates to exercise device, which may comprise exercise boards having wheels that do not rotate relative to their top plates, and wheeled exercise boards having rotatable feet mounts attached to their top plates. Related prior art comprising mutually couplable scooters having top plates that are parallel to a surface upon which they are positioned, wheeled balance boards, and dollies for moving furniture. What is lacking in the prior art is an exercise device comprising a platform having wheels that are rotatable relative to a top plate that is angled relative to a surface upon which the platform is positioned.

BRIEF SUMMARY OF THE INVENTION

An embodiment of the disclosure meets the needs presented above by generally comprising a platform, which comprises a top plate, a pair of endplates, and a plurality of wheels. Each endplate is attached singly proximate to and extends substantially perpendicularly from a respective opposed end of the top plate. Each wheel is attached to a respective endplate distal from the top plate. The wheels are configured to enable locomotion of the platform in any direction upon a substantially horizontal surface. The platform is configured to support legs of a user who is performing a plank exercise and enables the user to move along the substantially horizontal surface using their arms, thereby exercising at least core muscles and a cardiovascular system of the user.

Another embodiment of the disclosure includes a method of performing a plank exercise, which comprises a provision step entailing provision an abdominal exercise device, according to the disclosure above. Use steps of the method are positioning the abdominal exercise device on a substantially horizontal surface, positioning oneself for performing the plank exercise, and motivating the platform forward, backward, or both across the substantially horizontal surface using one's arms.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
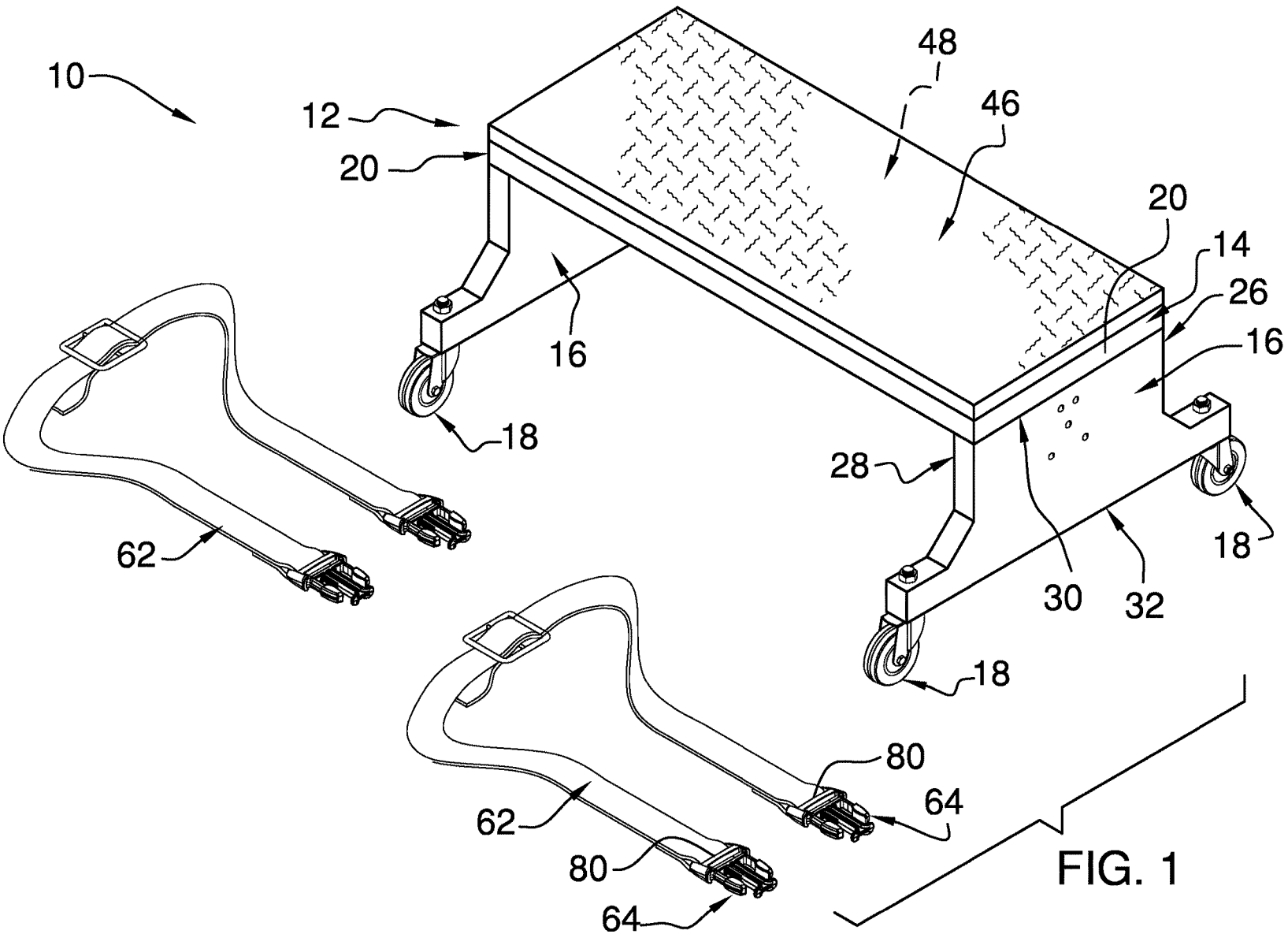
FIG. 1 is an isometric perspective view of an abdominal exercise device according to an embodiment of the disclosure.

With reference now to the drawings, and in particular to FIGS. 1 through 11 thereof, a new exercise device embodying the principles and concepts of an embodiment of the disclosure and generally designated by the reference numeral 10 will be described.

Figure 2:
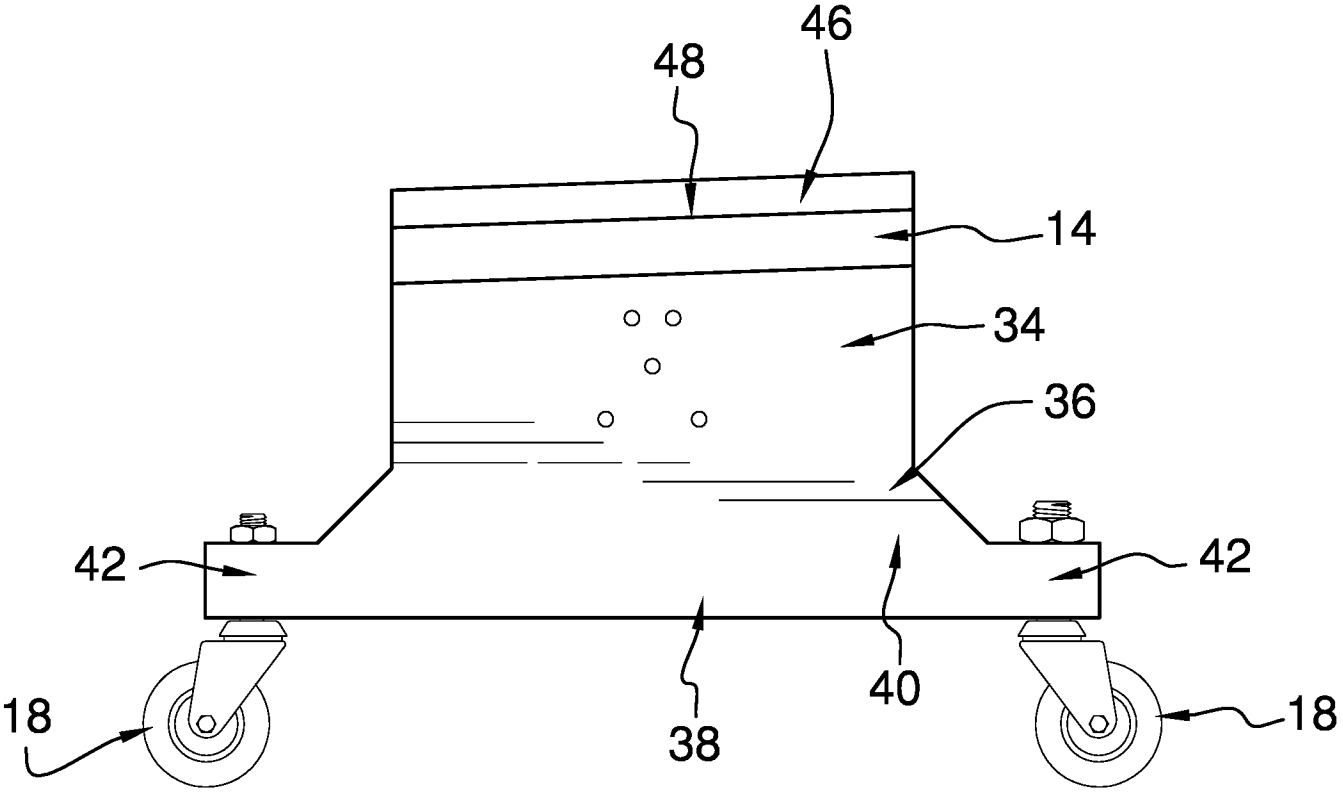
FIG. 2 is a side view of an embodiment of the disclosure.
Figure 3:
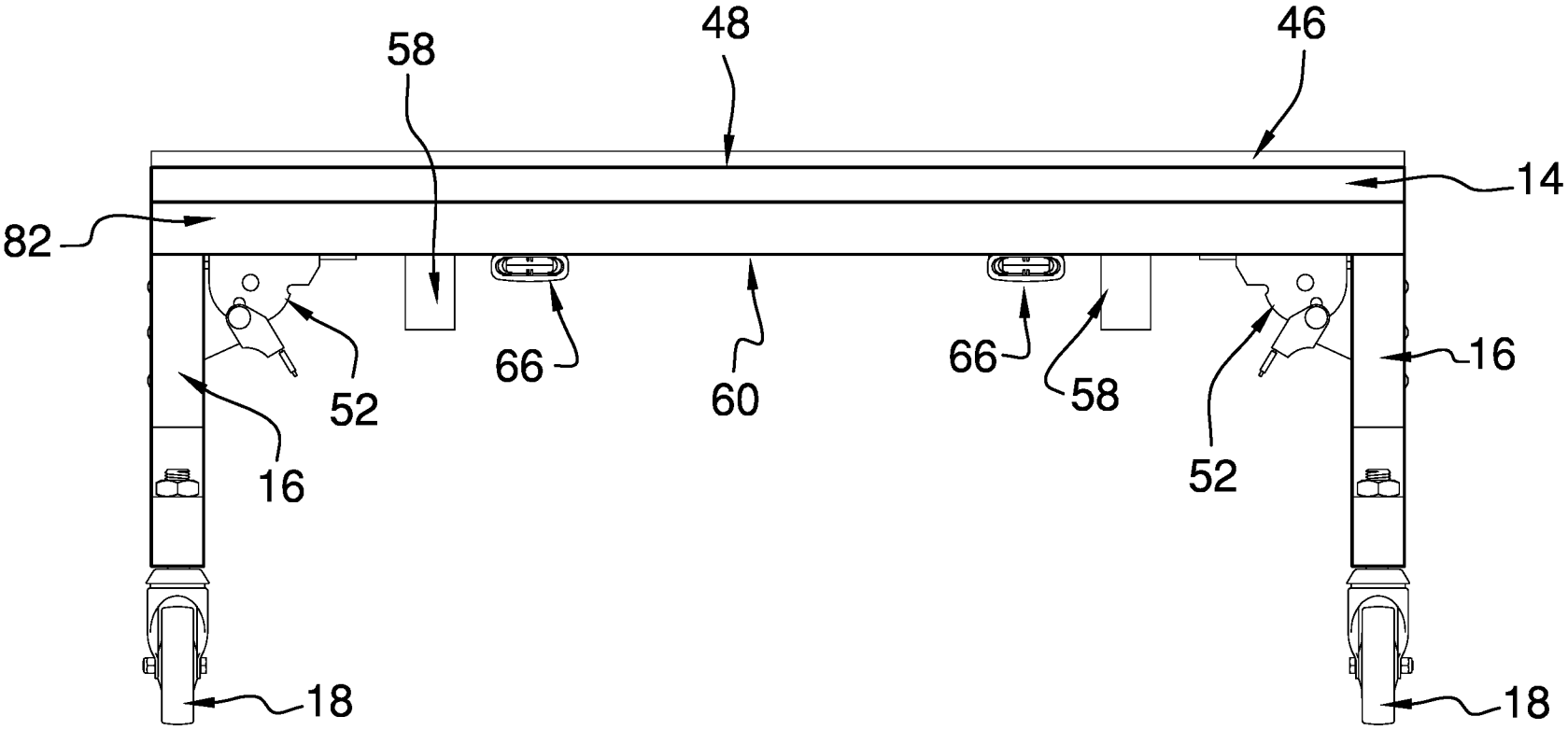
FIG. 3 is a front view of an embodiment of the disclosure.
Figure 4:
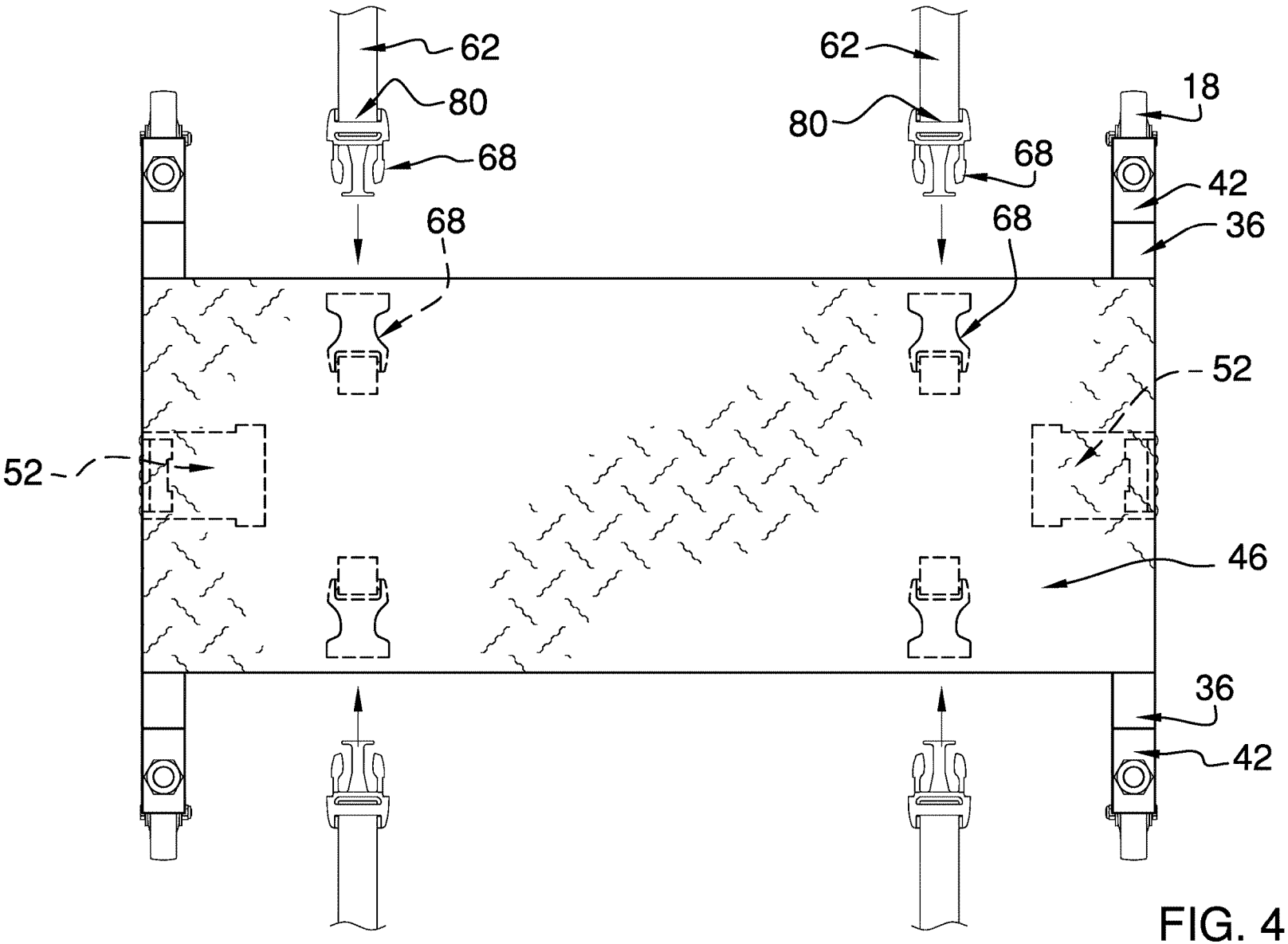
FIG. 4 is a top view of an embodiment of the disclosure.

As best illustrated in FIGS. 1 through 11, the abdominal exercise device 10 generally comprises a platform 12, which comprises a top plate 14, a pair of endplates 16, and a plurality of wheels 18. The top plate 14 may be rectangular, as shown in FIG. 4. However, as shaping of the top plate 14 is not critical to functioning of the abdominal exercise device 10, additional shapes, such as, but not limited to, oval, semicircular, or the like, are anticipated by the present invention.

Figure 6:
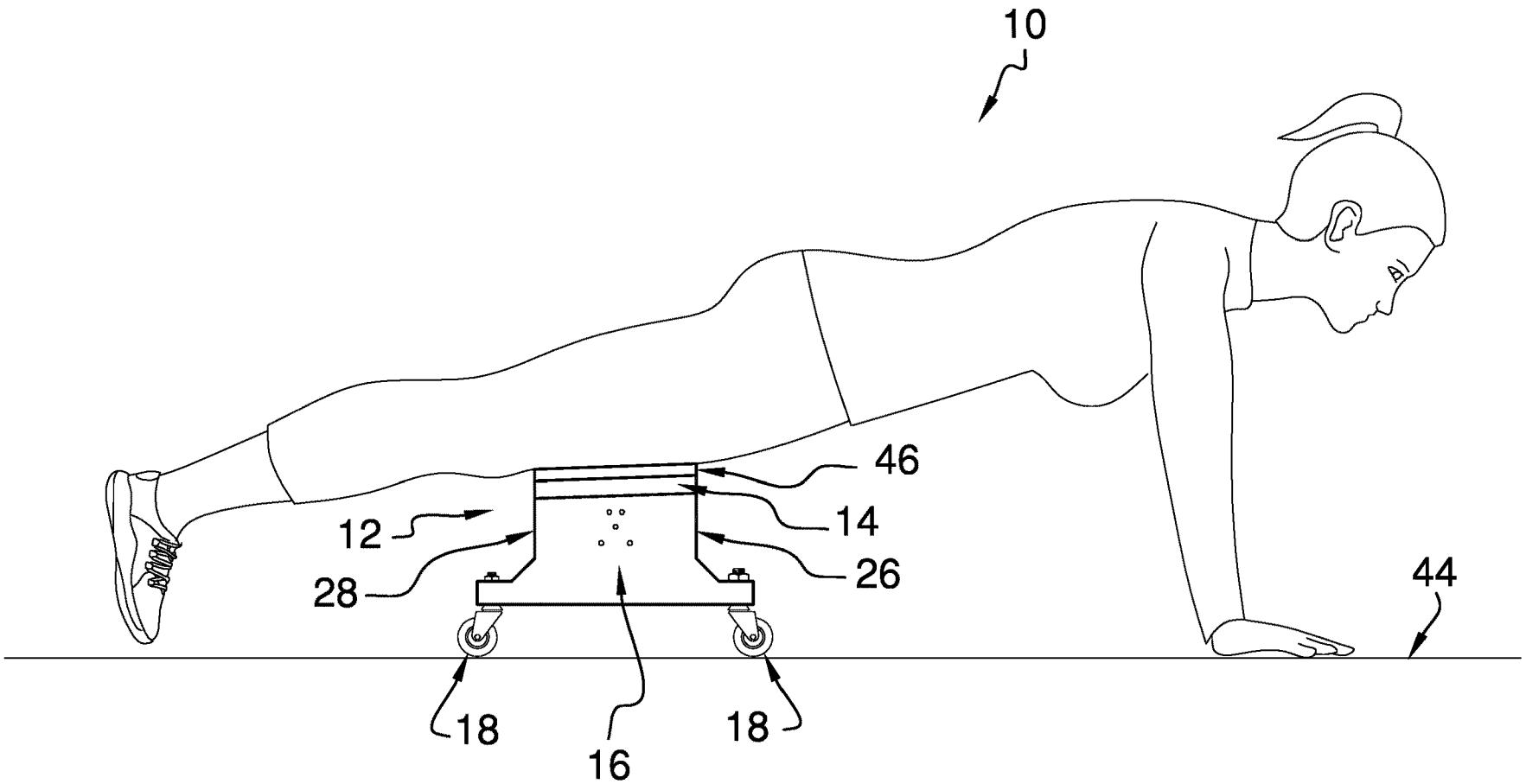
FIG. 6 is an in-use view of an embodiment of the disclosure.
Figure 8:
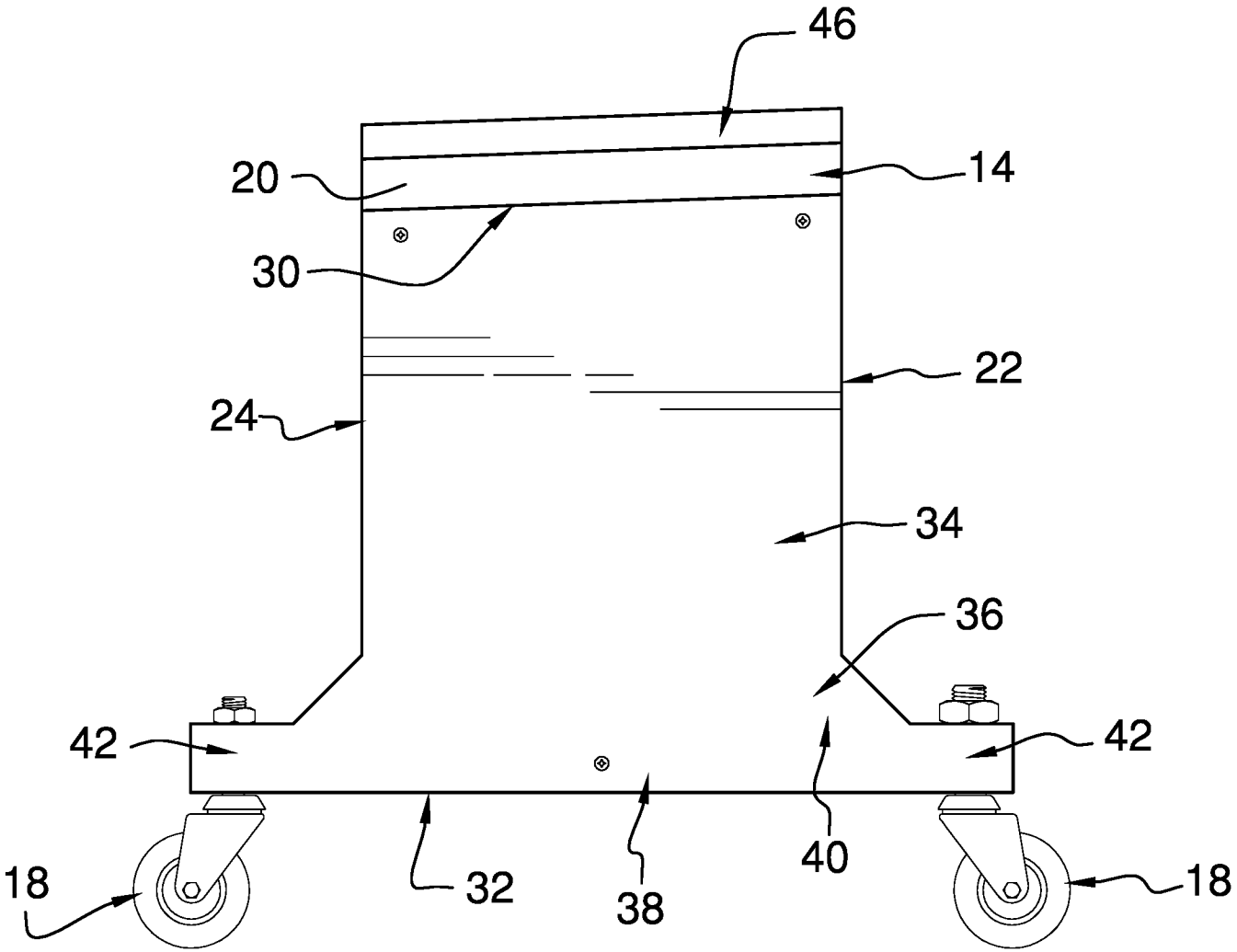
FIG. 8 is a side view of an embodiment of the disclosure.
Figure 9:
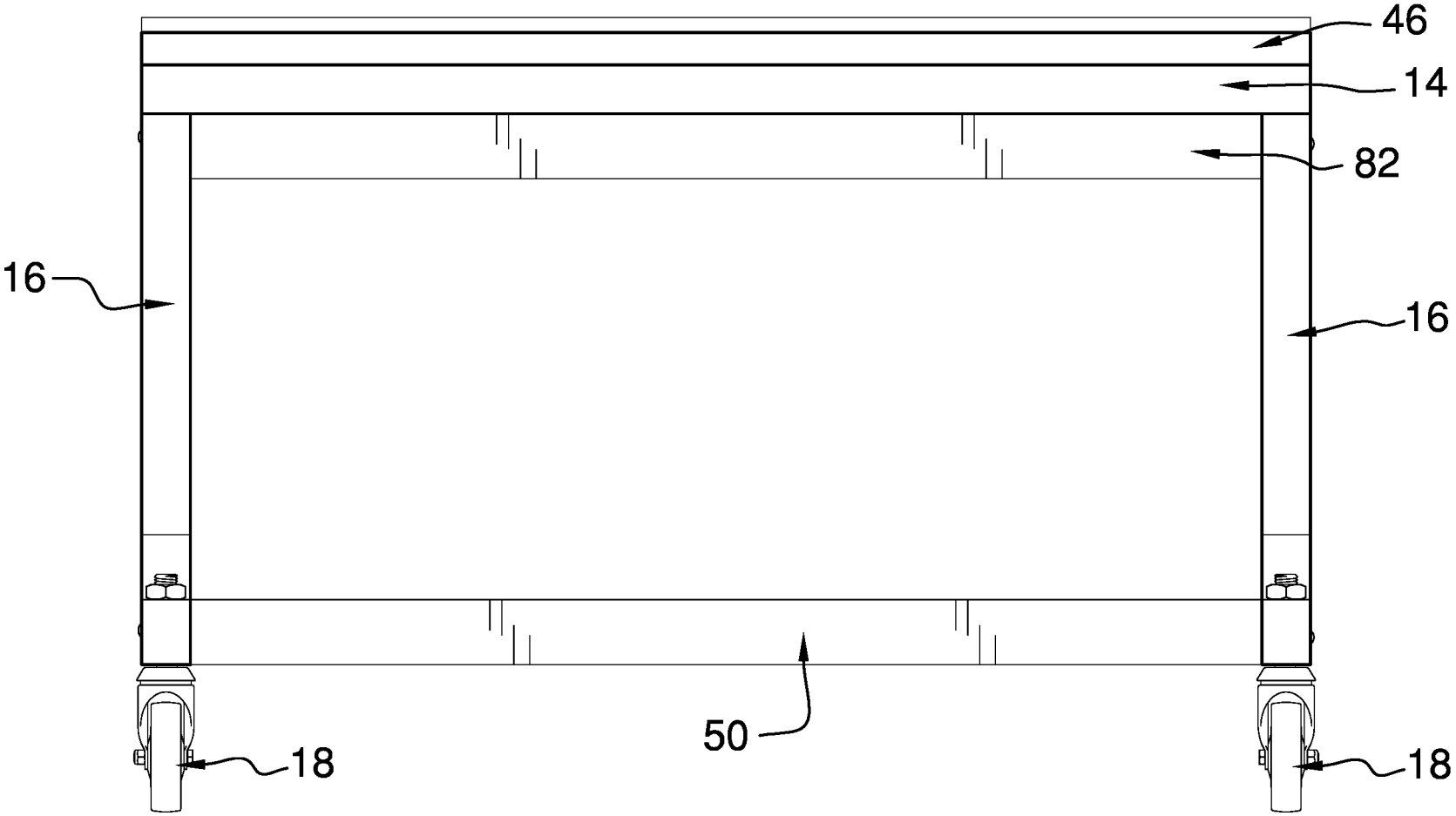
FIG. 9 is a front view of an embodiment of the disclosure.

Each endplate 16 is attached proximate to and extends substantially perpendicularly from a respective opposed end 20 of the top plate 14, as shown in FIG. 9. As shown in FIGS. 2 and 8, a forward edge 22 of each endplate 16 is dimensionally longer than a rearward edge 24 of the endplate 16 so that the top plate 14 tilts from a front 26 downwardly toward a rear 28 of the platform 12. As will become apparent and as is shown in FIG. 6, tilting of the top plate 14 facilitates alignment of a back or core of a user who is performing a plank exercise.

An upper end 30 of each endplate 16 is substantially length equivalent to a respective opposed end 20 of the top plate 14. A lower end 32 of each endplate 16 is dimensionally longer than a respective opposed end 20 of the top plate 14 so that the endplate 16 tapers from the upper end 30 to the lower end 32. The tapering of the endplates 16 enhances stability of the platform 12. A variety of configuration that effect tapering of the endplate 16 from the upper end 30 to the lower end 32 are anticipated by the present invention, such as, but not limited to, tapered frames, tapered plates of a variety of shapes, or the like.

In one configuration, wherein the endplate 16 tapers from the upper end 30 to the lower end 32, each endplate 16 comprises an upper piece 34, a medial piece 36, and a bottom piece 38. The upper piece 34 is attached to the top plate 14 and is substantially length equivalent to the respective opposed end 20 of the top plate 14. The upper piece 34 is substantially rectangular when viewed from the respective opposed end 20 of the top plate 14, as shown in FIG. 2. The medial piece 36 is attached to and extends coplanarly from the upper piece 34 distal from the top plate 14. The medial piece 36 is trapezoidal when viewed from the respective opposed end 20 of the top plate 14 so that a lower limit 40 of the medial piece 36 is wider than the upper piece 34. The bottom piece 38 is attached to and extends coplanarly from the lower limit 40 of medial piece 36. The bottom piece 38 is wider than the lower limit 40 of the medial piece 36 and defines a pair of overhangs 42.

Each wheel 18 is attached to a respective endplate 16 distal from the top plate 14. Generally, the plurality of wheels 18 comprises four wheels 18, which are positioned two-apiece on each endplate 16. More specifically, as shown in FIGS. 2 and 8, the wheels 18 are attached singly to each overhang 42 of each endplate 16. The wheels 18 are configured to enable locomotion of the platform 12 in any direction upon a substantially horizontal surface 44, such as floor, driveway, sidewalk, or the like.

A pad 46, which comprises foamed elastomer, rubber, silicone, or the like, is attached to an upper face 48 of the top plate 14 and is configured to cushion the legs of the user. The platform 12 thus is configured to comfortably support legs of a user who is performing a plank exercise, as shown in FIG. 6, wherein the platform 12 is positioned under thighs of the user. The platform 12 enables the user to move along the substantially horizontal surface 44 using their arms, thereby exercising at least core muscles and a cardiovascular system of the user. The closer the platform 12 is to ankles of the user, the more the core muscles must be engaged to maintain the plank position. With the wheels 18 being rotatable relative to the endplates 16, a user can move the platform 12 forwards, backwards, laterally, and diagonally.

Figure 7:
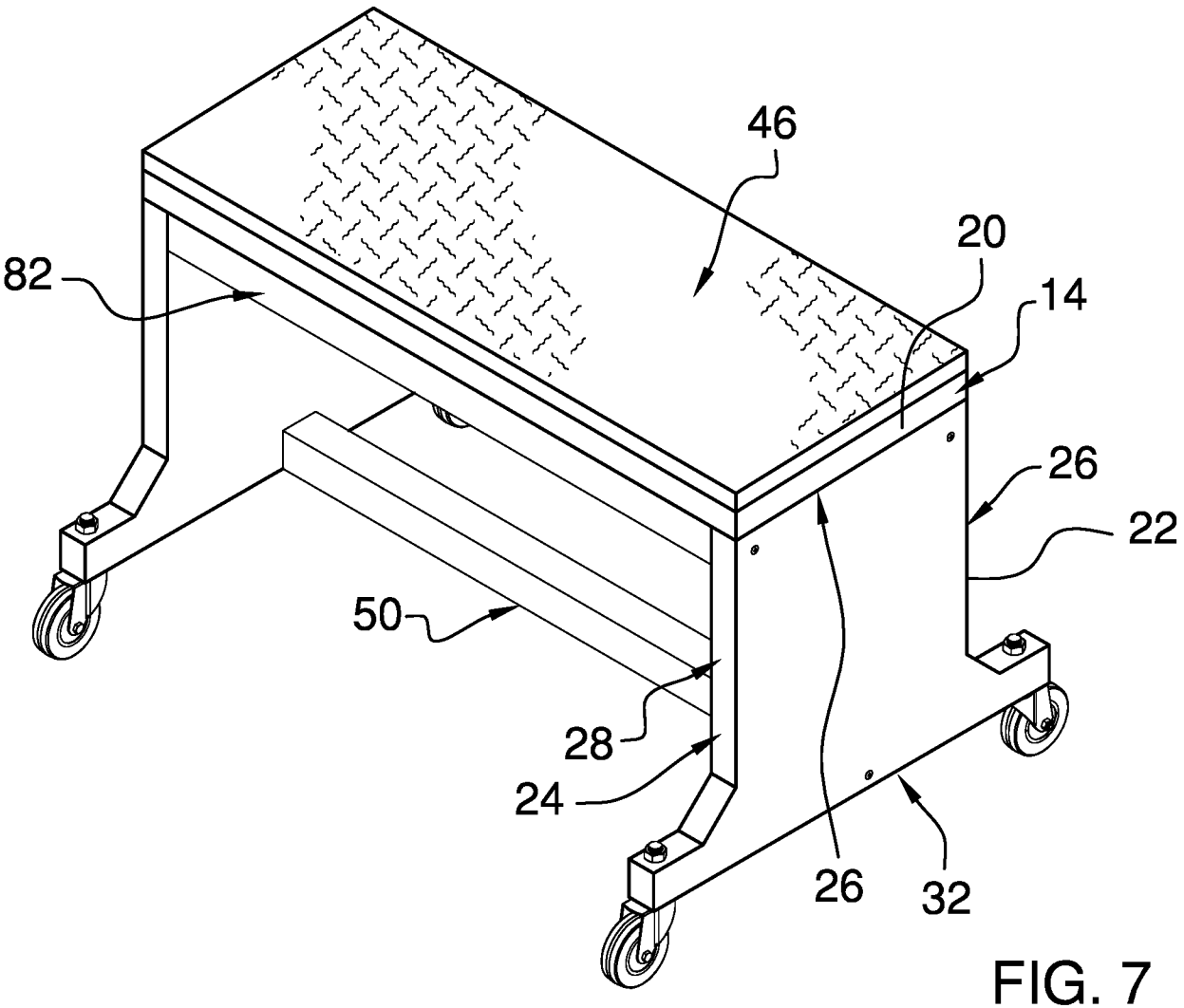
FIG. 7 is an isometric perspective view of an embodiment of the disclosure.

As shown in FIGS. 7 and 9, a crosspiece 50 is attached to and extends between the endplates 16 distal from the top plate 14 and stabilizes the pair of endplates 16 relative to the top plate 14. The crosspiece 50 renders the abdominal exercise device 10 non-foldable. Depending on what method of construction is employed, the platform 12 also may comprise horizontal bracing 82 between the endplates 16 proximate to the top plate 14, as shown in FIGS. 3, 5, 7, and 9.

Figure 5:
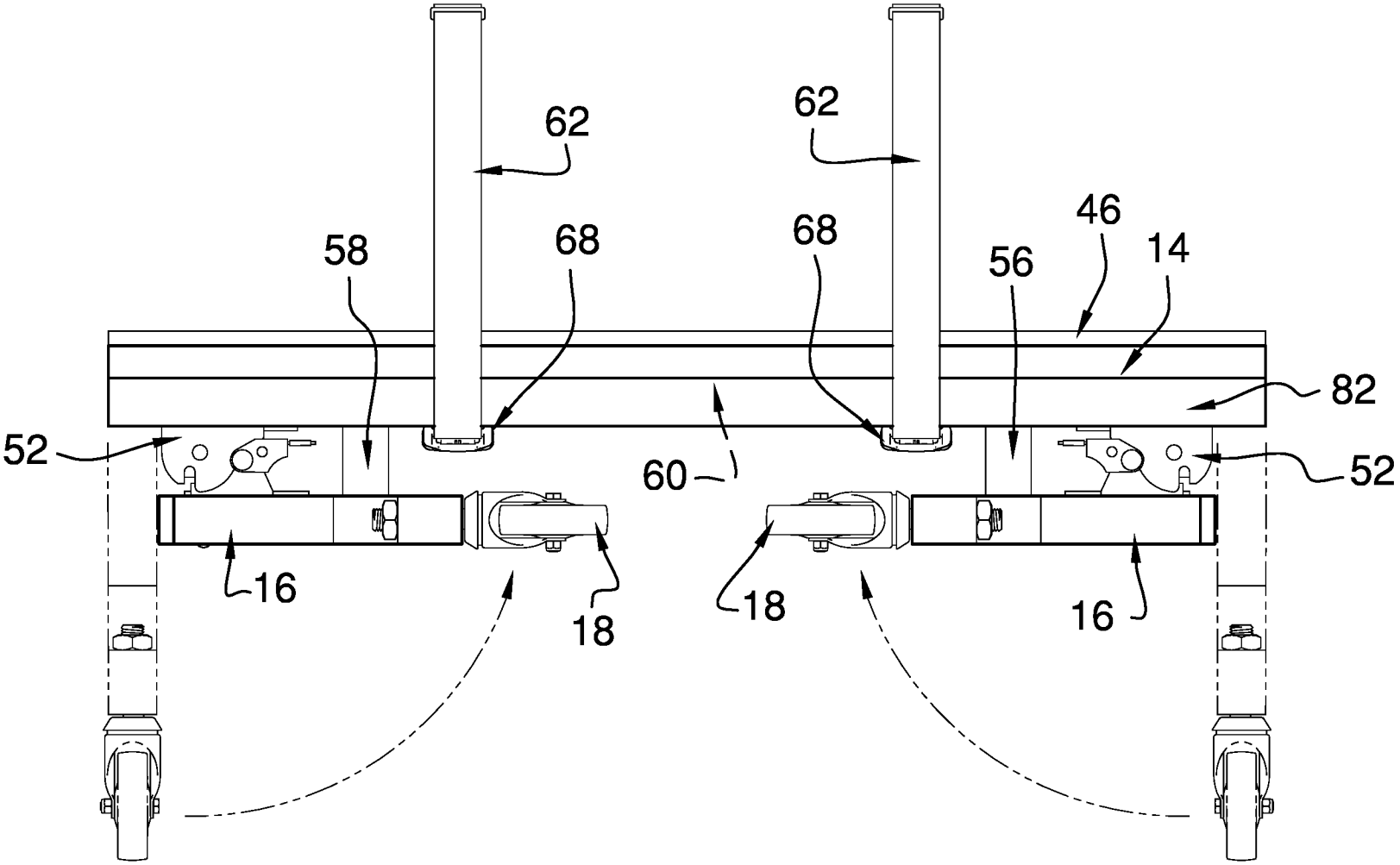
FIG. 5 is a front view of an embodiment of the disclosure.
Figure 10:
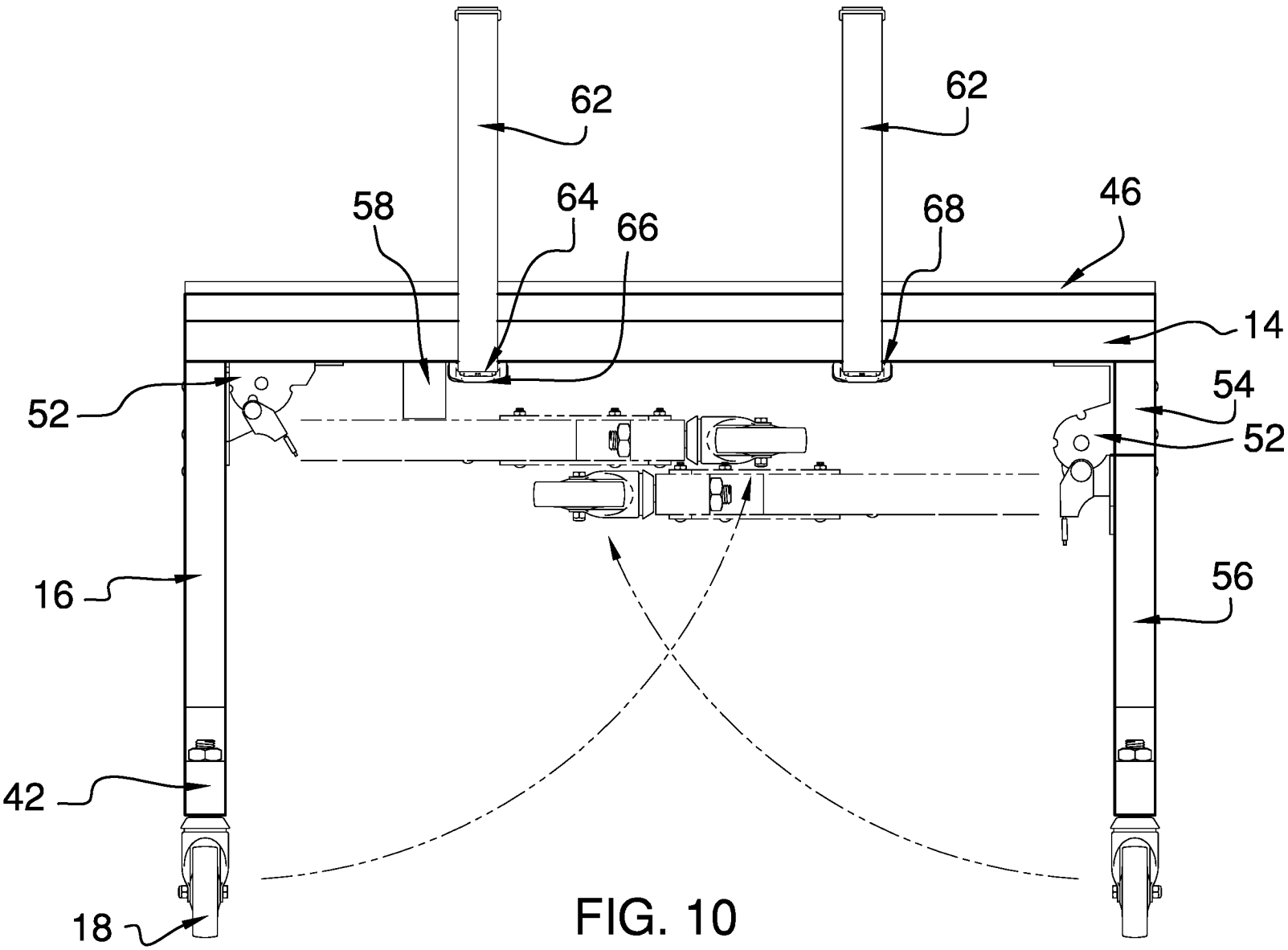
FIG. 10 is a front view of an embodiment of the disclosure.
Figure 11:
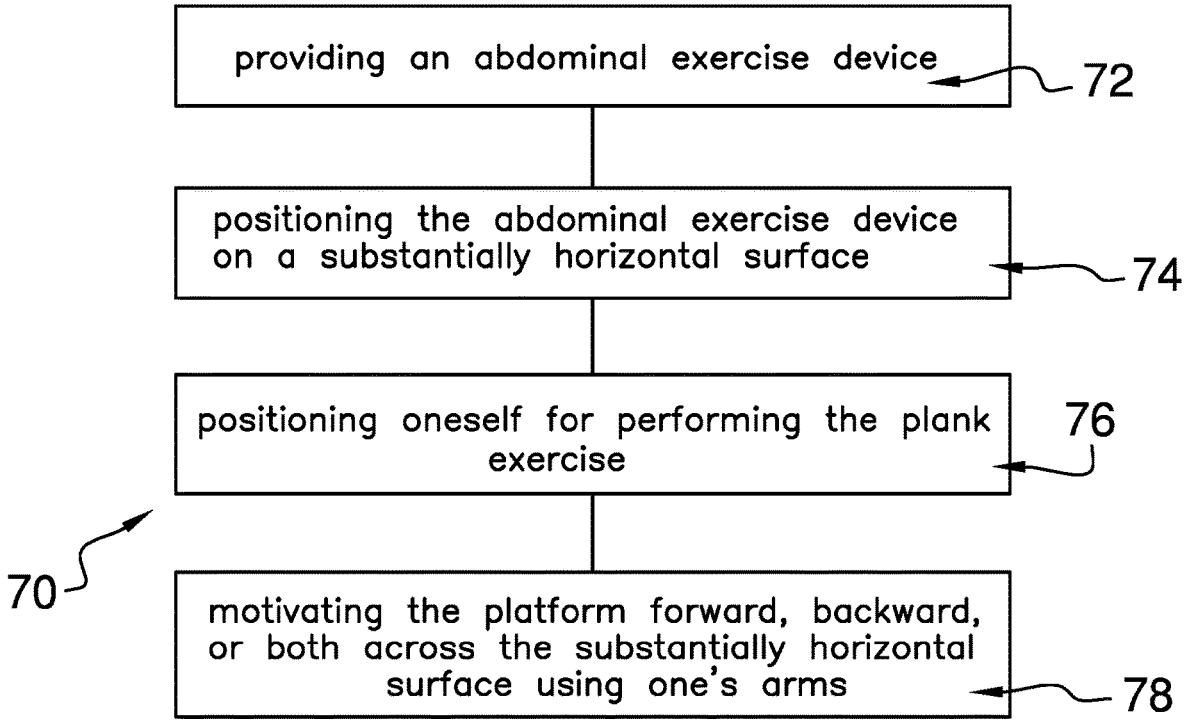
FIG. 11 is a flow diagram of a method utilizing an embodiment of the disclosure.

In another configuration, as shown in FIGS. 3, 5, and 10, the abdominal exercise device 10 is foldable by means of a plurality of hinges 52, which is attached to and which extends between the top plate 14 and the pair of endplates 16. Each hinge 52 is selectively lockable so that each endplate 16 is hingable from a deployed configuration, as shown in FIG. 3, wherein the endplate 16 is fixedly positioned substantially perpendicular to the top plate 14, and a stowed configuration, as shown in FIG. 5, wherein the endplate 16 is substantially parallel to the top plate 14. The plurality of hinges 52 may comprise two hinges 52, which are attached singly to the endplates 16, as shown in FIGS. 3-5. The present invention also anticipates the plurality of hinges 52 comprising four hinges 52 or six hinges 52.

As shown in FIG. 10, wherein the endplates 16 are elongated relative to the endplates 16 shown in the configuration depicted in FIG. 2, one of the hinges 52 (to the left in FIG. 10) is configured to hinge 900 and is attached to the top plate 14 and one of the endplates 16. The other of the hinges 52 (to the right in FIG. 10) is configured to hinge 1800 and is attached to a first section 54 and to a second section 56 of the other of the endplates 16. The second section 56 thus is hingable relative to the first section 54 so that the second section 56 overlays the one of the endplates 16 in the stowed configuration, as shown in FIG. 10. The abdominal exercise device 10 depicted in FIG. 10, being taller that the configuration depicted in FIG. 2, increases a difficulty level of the plank exercise and provides for a more vigorous workout of the core muscles.

As shown in FIGS. 5 and 10, a set of blocks 58 is attached to a lower face 60 of the top plate 12, with each block 58 being positioned to abut a respective endplate 16 upon hinging of the respective endplate 16 from the deployed to the stowed configuration. The set of blocks 58 comprises two blocks 58 and one block 58 for the configurations of the abdominal exercise device 10 depicted in FIGS. 5 and 10, respectively.

The abdominal exercise device 10 also may comprise a pair of straps 62, which is selectively attachable to the lower face 60 of the top plate 12. Each strap 62 is configured to be looped over a respective shoulder of the user, with the pad 46 being positioned between the top plate 12 and the user, to transport the platform 12. A plurality of first fasteners 64 is attached singly to opposing ends 80 of the straps 62 and a plurality of second fasteners 66 is attached to the lower face 60 of the top plate 12. The second fasteners 66 are complementary to the first fasteners 64 so that each second fastener 66 is positioned to selectively attach to a respective first fastener 64 to attach the pair of straps 62 to the top plate 12 with the straps 62 being loopedly positioned over shoulders of the user. The present invention anticipates the second fastener 66 and the respective first fastener 64 comprising a side release buckle 68, as shown in FIG. 4, or other fastening means, such as, but not limited to, hook and loop fasteners, buckles, or the like.

In use, the abdominal exercise device enables a method of performing a plank exercise 70. The method 70 comprises a provision step 72, which entails providing an abdominal exercise device, according to the specification above. A first use step 74 of the method 70 is positioning the abdominal exercise device on a substantially horizontal surface 44. A second use step 76 of the method 70 is positioning oneself for performing the plank exercise by taking a prone position with the platform 12 positioned at a point between one's hips and ankles, with the front 26 of the platform 12 facing one's hips, one's back substantially straight, and one's arms supporting the prone position. A third use step 78 of the method 70 is motivating the platform 12 forward, backward, or both across the substantially horizontal surface 44 using one's arms.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An abdominal exercise device comprising a platform, the platform comprising:

a top plate;

a pair of endplates attached singly proximate to and extending substantially perpendicularly from opposed ends of the top plate; and a plurality of wheels, each wheel being attached to a respective endplate of the pair of endplates distal from the top plate, wherein the plurality of wheels is configured for enabling locomotion of the platform in any direction upon a substantially horizontal surface, wherein the platform is configured for supporting legs of a user performing a plank exercise, enabling the user for moving along the substantially horizontal surface using their arms for exercising at least core muscles and a cardiovascular system of the user; and wherein each endplate of pair of endplates comprises:

an upper piece attached to the top plate and being substantially length equivalent to the respective opposed end of the top plate, the upper piece being substantially rectangular when viewed from the respective opposed end of the top plate;

a medial piece attached to and extending coplanarly from the upper piece distal from the top plate, the medial piece being trapezoidal when viewed from the respective opposed end of the top plate, such that a lower limit of the medial piece is wider than the upper piece; and a bottom piece attached to and extending coplanarly from the lower limit of medial piece, the bottom piece being wider than the lower limit of the medial piece defining a pair of overhangs.

2. The abdominal exercise device of claim 1, wherein the top plate is rectangular.

3. The abdominal exercise device of claim 1, further including a forward edge of each endplate of the pair of endplates being dimensionally longer than a rearward edge of the endplate, such that the top plate tilts from a front downwardly toward a rear of the platform.

4. The abdominal exercise device of claim 1, further including:

an upper end of each endplate of the pair of endplates being substantially length equivalent to a respective opposed end of the top plate; and a lower end of each endplate of pair of endplates being dimensionally longer than a respective opposed end of the top plate.

5. The abdominal exercise device of claim 1, wherein the plurality of wheels comprises four wheels positioned two-apiece on each endplate of the pair of endplates.

6. The abdominal exercise device of claim 1, wherein the wheels of the plurality of wheels are attached singly to each overhang of the pair of overhangs of each endplate of the pair of endplates.

7. The abdominal exercise device of claim 1, further including a pad attached to an upper face of the top plate, wherein the pad is configured for cushioning the legs of the user.

8. The abdominal exercise device of claim 7, wherein the pad comprises foamed elastomer, rubber, or silicone.

9. The abdominal exercise device of claim 1, further including a crosspiece attached to and extending between the endplates of the pair of endplates distal from the top plate, such that the crosspiece stabilizes the pair of endplates relative to the top plate.

10. The abdominal exercise device of claim 1, further including a plurality of hinges attached to and extending between the top plate and the pair of endplates, each hinge of the plurality of hinges being selectively lockable, such that each endplate of the pair of endplates is hingable from a deployed configuration, wherein the endplate is fixedly positioned substantially perpendicular to the top plate, and a stowed configuration, wherein the endplate is substantially parallel to the top plate.

11. The abdominal exercise device of claim 10, wherein the plurality of hinges comprising two hinges attached singly to the endplates of the pair of endplates.

12. The abdominal exercise device of claim 11, wherein:

one of the hinges is configured for hinging 90° and is attached to the top plate and one of the endplates; and the other of the hinges is configured for hinging 180° and is attached to a first section and a second section of the other of the endplates, such that the second section is hingable relative to the first section and such that the second section overlays the one of the endplates in the stowed configuration.

13. The abdominal exercise device of claim 11, further including a set of blocks attached to a lower face of the top plate, each block being positioned for abutting a respective endplate of the pair of endplates upon hinging of the respective endplate from the deployed to the stowed configuration.

14. The abdominal exercise device of claim 10, further including a pair of straps selectively attachable to a lower face of the top plate, wherein each strap of the pair of straps are configured for looping over a respective shoulder of the user, with the pad being positioned between the top plate and the user, for transporting the platform.

15. The abdominal exercise device of claim 14, further including:

a plurality of first fasteners attached singly to opposing ends of the straps of the pair of straps; and a plurality of second fasteners attached to the lower face of the top plate, the second fasteners of the plurality of second fasteners being complementary to the first fasteners of the plurality of first fasteners, such that each second fastener of the plurality of second fasteners is positioned for selectively attaching to a respective first fastener of the plurality of first fasteners for attaching the pair of straps to the top plate with the straps of the pair of straps loopedly positioned over shoulders of the user.

16. An abdominal exercise device comprising a platform, the platform comprising:

a top plate, the top plate being rectangular;

a pair of endplates attached singly proximate to and extending substantially perpendicularly from opposed ends of the top plate, a forward edge of each endplate of the pair of endplates being dimensionally longer than a rearward edge of the endplate, such that the top plate tilts from a front downwardly toward a rear of the platform, an upper end of each endplate of the pair of endplates being substantially length equivalent to a respective opposed end of the top plate, a lower end of each endplate of pair of endplates being dimensionally longer than a respective opposed end of the top plate, each endplate of pair of endplates comprising:

an upper piece attached to the top plate and being substantially length equivalent to the respective opposed end of the top plate, the upper piece being substantially rectangular when viewed from the respective opposed end of the top plate, a medial piece attached to and extending coplanarly from the upper piece distal from the top plate, the medial piece being trapezoidal when viewed from the respective opposed end of the top plate, such that a lower limit of the medial piece is wider than the upper piece, and a bottom piece attached to and extending coplanarly from the lower limit of medial piece, the bottom piece being wider than the lower limit of the medial piece defining a pair of overhangs;

a plurality of wheels, each wheel being attached to a respective endplate of the pair of endplates distal from the top plate, wherein the plurality of wheels is configured for enabling locomotion of the platform in any direction upon a substantially horizontal surface, wherein the platform is configured for supporting legs of a user performing a plank exercise, enabling the user for moving along the substantially horizontal surface using their arms for exercising at least core muscles and a cardiovascular system of the user, the plurality of wheels comprising four wheels positioned two-apiece on each endplate of the pair of endplates, the wheels of the plurality of wheels being attached singly to each overhang of the pair of overhangs of each endplate of the pair of endplates; and a pad attached to an upper face of the top plate, wherein the pad is configured for cushioning the legs of the user, the pad comprising foamed elastomer, rubber, or silicone.

17. The abdominal exercise device of claim 16, further including a crosspiece attached to and extending between the endplates of the pair of endplates distal from the top plate, such that the crosspiece stabilizes the pair of endplates relative to the top plate.

18. The abdominal exercise device of claim 16, further including:

a plurality of hinges attached to and extending between the top plate and the pair of endplates, each hinge of the plurality of hinges being selectively lockable, such that each endplate of the pair of endplates is hingable from a deployed configuration, wherein the endplate is fixedly positioned substantially perpendicular to the top plate, and a stowed configuration, wherein the endplate is substantially parallel to the top plate, the plurality of hinges comprising two hinges attached singly to the endplates of the pair of endplates, one of the hinges being configured for hinging 90° and being attached to the top plate and one of the endplates, the other of the hinges being configured for hinging 180° and being attached to a first section and a second section of the other of the endplates, such that the second section is hingable relative to the first section and such that the second section overlays the one of the endplates in the stowed configuration;

a set of blocks attached to a lower face of the top plate, each block being positioned for abutting a respective endplate of the pair of endplates upon hinging of the respective endplate from the deployed to the stowed configuration;

a pair of straps selectively attachable to a lower face of the top plate, wherein each strap of the pair of straps are configured for looping over a respective shoulder of the user, with the pad being positioned between the top plate and the user, for transporting the platform;

a plurality of first fasteners attached singly to opposing ends of the straps of the pair of straps; and a plurality of second fasteners attached to the lower face of the top plate, the second fasteners of the plurality of second fasteners being complementary to the first fasteners of the plurality of first fasteners, such that each second fastener of the plurality of second fasteners is positioned for selectively attaching to a respective first fastener of the plurality of first fasteners for attaching the pair of straps to the top plate with the straps of the pair of straps loopedly positioned over shoulders of the user, the second fastener and the respective first fastener comprising a side release buckle.

19. A method of performing a plank exercise comprising the steps of:

providing an abdominal exercise device comprising a platform, the platform comprising:

a top plate, a pair of endplates attached singly proximate to and extending substantially perpendicularly from opposed ends of the top plate, and a plurality of wheels, each wheel being attached to a respective endplate of the pair of endplates distal from the top plate, wherein the plurality of wheels is configured for enabling locomotion of the platform in any direction upon a substantially horizontal surface, wherein the platform is configured for supporting legs of a user performing a plank exercise, enabling the user for moving along the substantially horizontal surface using their arms for exercising at least core muscles and a cardiovascular system of the user;

positioning the abdominal exercise device on a substantially horizontal surface;

positioning oneself for performing the plank exercise by taking a prone position with the platform positioned at a point between one's hips and ankles, with the front of the platform facing one's hips, one's back being substantially straight, and one's arms supporting the prone position; and motivating the platform forward, backward, or both across the substantially horizontal surface using one's arms.

* * * * *